US008032054B2

(12) United States Patent
Hollar et al.

(10) Patent No.: US 8,032,054 B2
(45) Date of Patent: Oct. 4, 2011

(54) SYSTEM FOR INSTALLING A CONTINUOUS BELT IN A MARKING SYSTEM

(75) Inventors: Thomas C. Hollar, Penfield, NY (US); Paul DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 442 days.

(21) Appl. No.: 12/247,561

(22) Filed: Oct. 8, 2008

(65) Prior Publication Data

US 2010/0086327 A1 Apr. 8, 2010

(51) Int. Cl.
*G03G 15/00* (2006.01)
*G03G 15/08* (2006.01)
*G03G 15/20* (2006.01)

(52) U.S. Cl. ..... 399/110; 399/107; 399/121; 399/162; 399/165; 399/313

(58) Field of Classification Search ..... 399/107, 399/162, 163, 165, 110
See application file for complete search history.

(56) References Cited

U.S. PATENT DOCUMENTS 2,868,369 A * 1/1959 Webb ..... 242/160.2
3,186,543 A * 6/1965 Minick et al. ..... 206/393
3,942,637 A * 3/1976 Glennie ..... 206/389
4,811,839 A * 3/1989 Cornell et al. ..... 206/303
5,049,928 A * 9/1991 Tirone ..... 355/72
5,119,133 A * 6/1992 Swain ..... 399/163
5,400,121 A * 3/1995 Foote ..... 399/116
5,708,924 A * 1/1998 Shogren et al. ..... 399/116
6,233,415 B1 * 5/2001 Pang ..... 399/116
6,752,261 B1 * 6/2004 Gaeddert et al. ..... 198/861.1
6,792,231 B2 * 9/2004 Maier et al. ..... 399/121
6,905,018 B2 * 6/2005 Darcy et al. ..... 206/303
7,773,909 B2 * 8/2010 Rumpel et al. ..... 399/107
2003/0138267 A1 * 7/2003 Yamazaki et al. ..... 399/162
2003/0183493 A1 * 10/2003 Ertel et al. ..... 198/841
2008/0118269 A1 * 5/2008 Asaoka et al. ..... 399/121

* cited by examiner

*Primary Examiner* — David Gray
*Assistant Examiner* — David Bolduc
(74) *Attorney, Agent, or Firm* — Ronald E. Prass, Jr.; Prass LLP

(57) ABSTRACT

A cartridge and method that is useful in installing an endless belt in one or more modules of a belt containing system is disclosed. The cartridge may include at least two internal cartridge rolls around which said belt is wound, a traveling roll around which belt is positioned, and gear racks on which said traveling roll will move, said belt being movably connected on one end to one of said internal cartridge rolls and on an opposite end to said traveling roll, end caps located at each end of said internal cartridge rolls, said end caps and internal cartridge rolls having conduits therethrough, and a sheath to cover and contain said internal cartridge rolls.

19 Claims, 6 Drawing Sheets

SYSTEM FOR INSTALLING A CONTINUOUS BELT IN A MARKING SYSTEM

This invention relates to belt systems including an electrophotographic marking system that utilizes a continuous belt.

BACKGROUND

The continuous belt described in this disclosure includes a wide range of applicable belts including systems using media belts, photoconductor belts, photoreceptor belts, intermediate transfer belts, electrostatic belts and transport belts. While the present invention can be used in all of these above-noted systems, it will be described herein for clarity as used in electrostatic marking systems.

By way of an example, in one color system, an array or series of different color imaging stations are aligned above an endless belt. Each imaging station contains a raster output scanner (ROS), photoreceptor drum, development station and cleaning station. The ROS emits an electronic beam (laser) which impinges on the rotating photoconductive drum thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by and in contact with the photoreceptor drum. As the intermediate belt passes by the different imaging stations (each usually containing a different color), it picks up subsequent color layers to create a complete color image which is then transferred to media.

In today's high speed systems, the intermediate belt is in contact with several abrading components of the marking system such as other belts, drums, rolls, cleaning blades/brushes, etc. and frequently needs replacement. Care must be taken when installing new belts since even minor damage to the belt could cause it to lose functionality totally or partially. Current methods require handling of exposed and/or loose belt to place belt over a series of rollers. Removal/handling of a belt module and removal/handling of the belt increases probability of module/belt damage. The complication of the current prior art approach restricts continuous belt replacement to a technical service call.

In these electrostatic marking systems, a photoreceptor belt surface is generally arranged to move in an endless path through the various processing stations of the xerographic process. Sometimes, the photoreceptor or photoconductor surface is in the form of an endless belt and in other systems it is in the form of a drum. In this endless path, several xerographic-related stations are traversed by the photoconductive belt, which becomes worn as are belts in several of these stations in various belt configurations. In addition to photosensitive belts included for use in this invention are transfer belts, intermediate transfer belts, and the like. Each of these belts is exposed to friction and moved by rollers that provide the belt movement to accomplish the belt purpose. After awhile, the belt needs to be replaced. Since the intermediate transfer and photoreceptor surface in particular are reusable, the surface of the belts is constantly abraded and cleaned by a blade and/or brushes and prepared to be used once again in the marking process.

Image-carrying belts such as intermediate or photoreceptor belts used in color printing processes can be especially difficult to replace and install. In some machines, the horizontal intermediate transfer belt is over 6-10 feet long; however, any suitable length belt may be used in the present invention. Belt installation requires careful alignment with the belt module to prevent belt damage. At even longer belt lengths, the replacement operation is extremely difficult to install without belt damage occurring.

Even in monochromatic marking systems that use shorter belts for various functions, extreme care must be taken not to damage the belts during installation. In some instances, the belts are constructed of thin flexible polymeric materials that can easily scratch or be damaged during belt replacement or even during original installation.

Embodiments of belt installation of this invention in marking systems provide belt alignment during the installation process with a minimum of belt damage.

SUMMARY

The present invention provides a cartridge or kit and a system for installing continuous belts in a marking or non-marking system. As noted above for clarity, the present invention will be described with reference to a xerographic color or monochrome marking system.

The present invention addresses the problem of installing a long continuous belt such as may be required for present day high speed marking systems. Current prior art methods require handling of the exposed or loose stationary holder belt to place it over a series of rolls with risk of damage and normally requires a service call. The present invention consists of a self-contained cartridge or kit with a rolled or coiled continuous belt. The cartridge would be installed on one of the print device drive or idler rolls at one end of the belt path. The outer covering of the belt cartridge would be removed to allow access to a traveling roll containing one end of the continuous belt. The traveling roll would be engaged to a pair of mating gear tooth racks in the printer. The traveling roll would be turned or translated to advance the belt to the opposite end of the printing device for belt installation to a print device roll that mounts the belt. The traveling roll may be moved manually or mechanically depending on design embodiment. The empty cartridge would then be removed. This invention addresses the difficult problem of how to install a very long belt through a complex set of imaging modules in some instances obstructed by the machine components. The method will require the rolls, backer bars and other components that operate inside the belt during running of the machine to be easily removed or moved out of the way while the belt is being deployed. The method has the advantage of scaling well to very long belts.

DETAILED DISCUSSION OF DRAWINGS AND PREFERRED EMBODIMENTS

Figure 1:
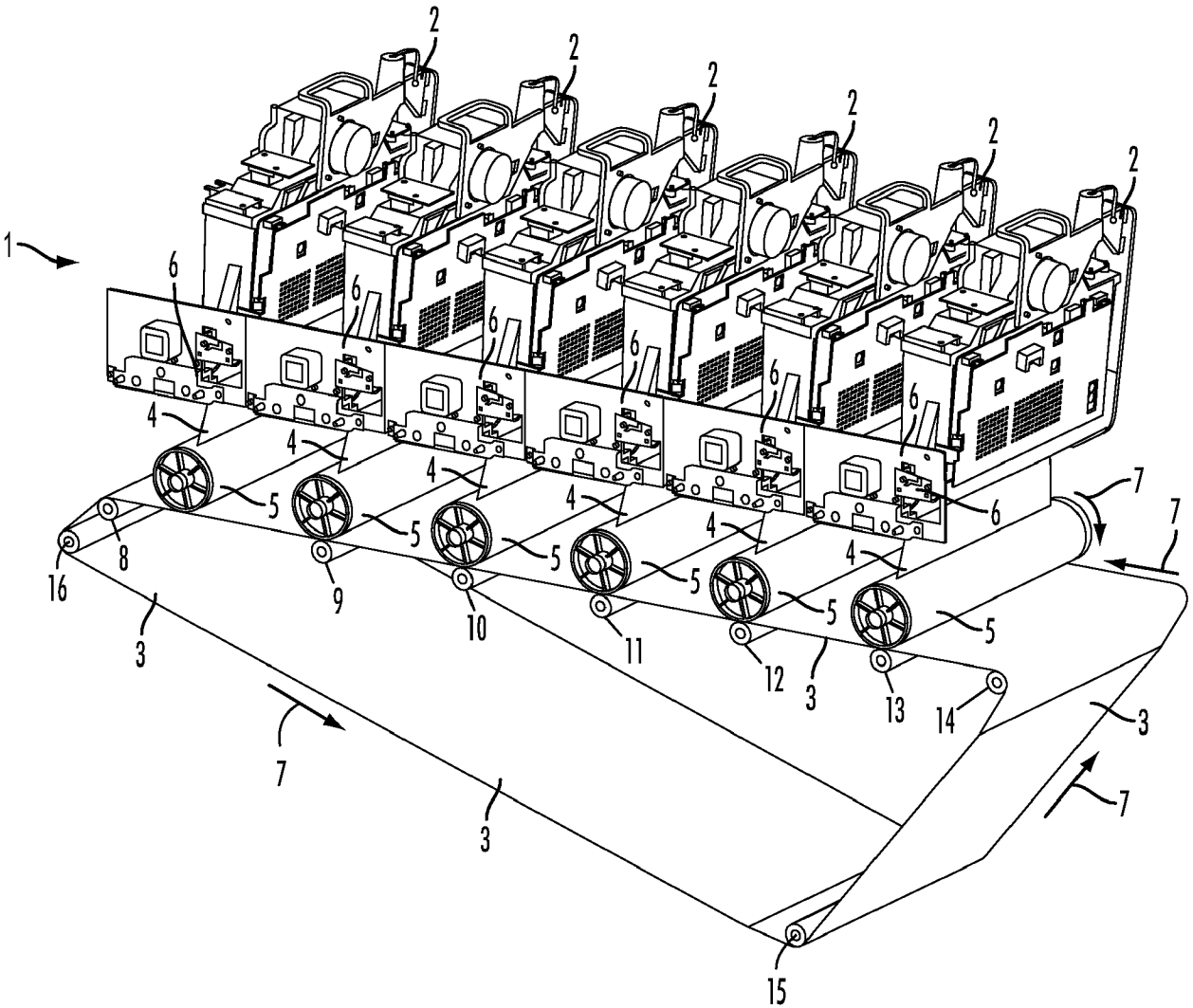
FIG. 1 PRIOR ART
FIG. 1 is a perspective view of a typical prior art six station intermediate belt transfer xerographic system where this belt travels through six modules or xerographic marking stations.

In FIG. 1, a typical six module color electrophotographic marking system 1 is illustrated having six ROS-2, with an endless belt 3, xerographic drums 5, image beams 4 and six modules 6. The arrows 7 indicate the rotation direction of the endless belt 3. This type of continuous belt 3 would be one instance of a belt that requires replacement after prolonged use. Several rolls direct and support the belt 3 such as rolls 8-16. When installing the new belt using the cartridge of this invention. All rolls 13 and 15 are removed leaving rolls 16 and 14 as the rolls to be used in the belt installation process as will be described in reference to the other Figures.

Figure 2:
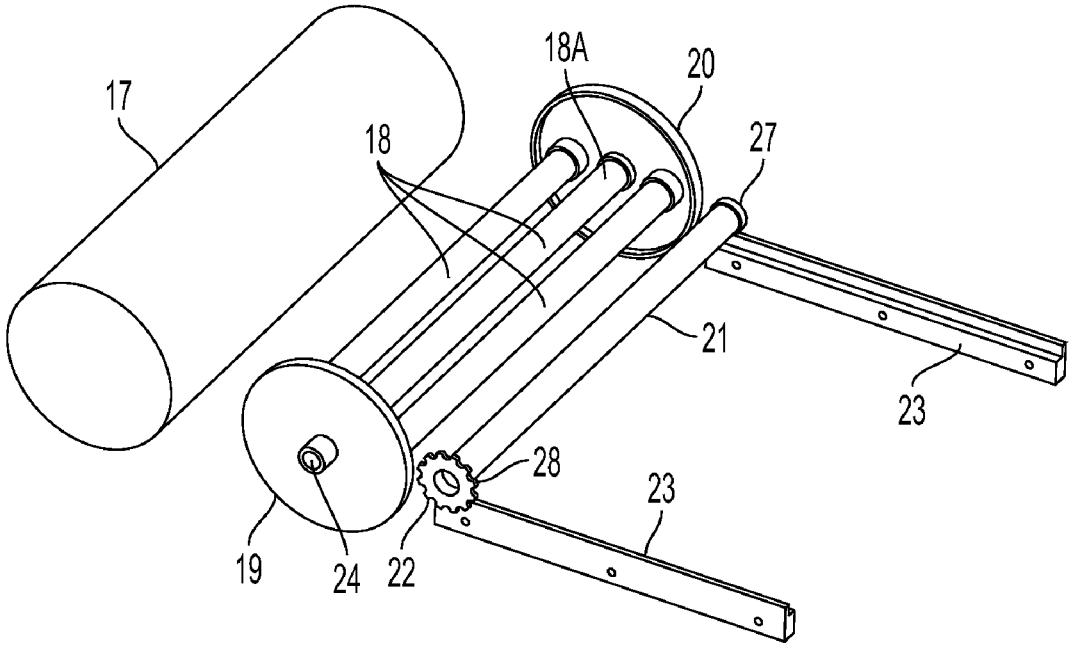
FIG. 2 illustrates the cartridge or kit components of an embodiment of this invention.

In FIG. 2, the cartridge components (less the belt) are shown. The cartridge comprises a sheath or packaging 17, three internal cartridge rolls 18 with front end cap 19 and rear end cap 20, a traveling roll 21 with a mechanical knob 22 to move the traveling roll 21 along gear racks 23 on which the traveling roll 21 will move. The belt cartridge is made up of several pieces that provide the means to mount and protect the belt 3 during storage and belt installation. The configuration depicted incorporates three rolls 18 and one roll 21 to hold, coil, align and uncoil the belt 3. The two cartridge end caps 19 and 20 provide mounting for the three internal cartridge rolls 18 and the internal end cap bores 24 provide mounting on the print engine drive/idler shaft. The fourth roll is a traveling roll 21 that has a gear tooth form 27 and 28 on both inboard and outboard ends. The traveling roll end cap gear tooth form 27 and 28 is engaged to a mating pair of gear racks 23 to enable positive uniform movement of the traveling roll 21 to the opposite end of the belt module. The cartridge is protected by a removable sheath 17. FIG. 2 does not show belt 3 for clarity. The actual design and shape of the parts may differ from those depicted.

The cartridge 26 will be placed in the print device between two frame members on one of the main drive/idler rolls 16. (See FIG. 1.) The compact design and ease of mounting the cartridge 26 into the print device 1 should enable customer replacement of continuous belts 3. (See FIG. 3.)

Figure 4:
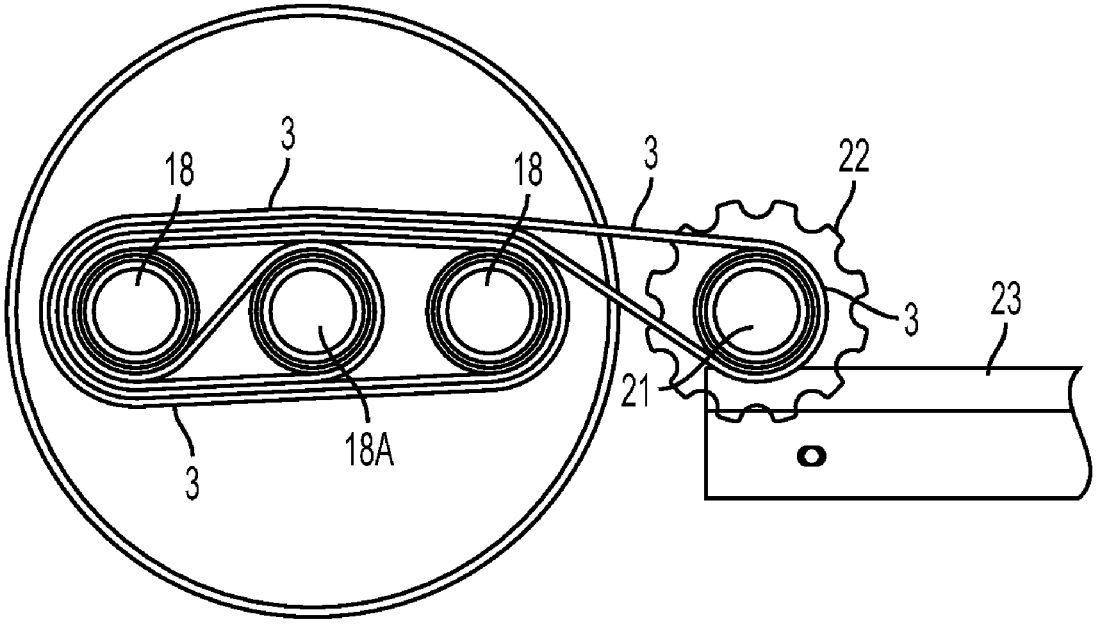
FIG. 4 illustrates the sheath of the cartridge removed and the traveling roll moved out of the cartridge and engaged at the beginning of the gear rack.

The belt 3 stationary loop (end) is mounted on the center roll 18A in the belt cartridge 26. The belt 3 is then coiled around the two outside rolls 18 to enable cartridge rotation as the traveling roll 21 is moved laterally across the print device. The three roll 18 concept is employed to avoid the possibility of a kink in the continuous belt 3. FIG. 4 depicts the system with the sheath removed and traveling roll engaged on the gear racks.

The center cartridge roll 18A and the traveling roll 21 will act as a temporary belt mount to allow the belt 3 to be transitioned to the print device drive/idler rolls 16 and 14. The traveling roll 21 will be located through the insertion of the machine drive/idler roll 14. The cartridge roll 18 with end cap 19 and traveling roll 21 will be removed to allow the print device shafts/rolls to engage the inner surface of the media/photoconductor belt. The inboard belt cartridge end cap 20 will be removed after installation is complete and all additional backer rolls and belt module components will be placed in working position to complete belt alignment and tensioning. (See FIG. 5.)

Figure 2A:
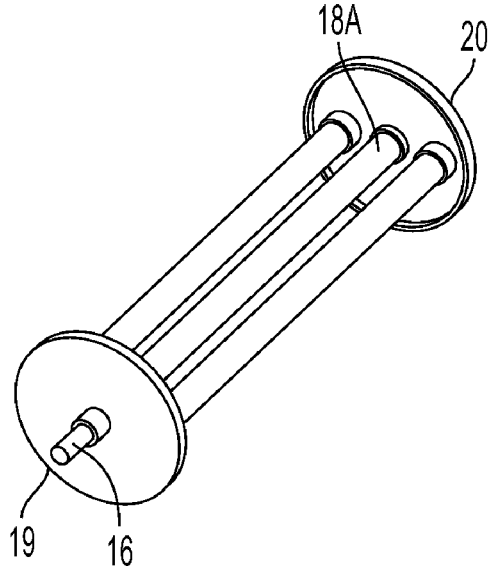
FIG. 2A shows the cartridge installed on the drive roller at the beginning of the belt installation.

FIG. 2A shows the mounting of the cartridge 26 (minus the belt 3) onto roll 16 at the beginning of the belt installation process. The caps 19 and 20 of the cartridge 26 would rotate around roll 16 until the belt 3 has unwound from the position shown in FIG. 4.

Figure 3:
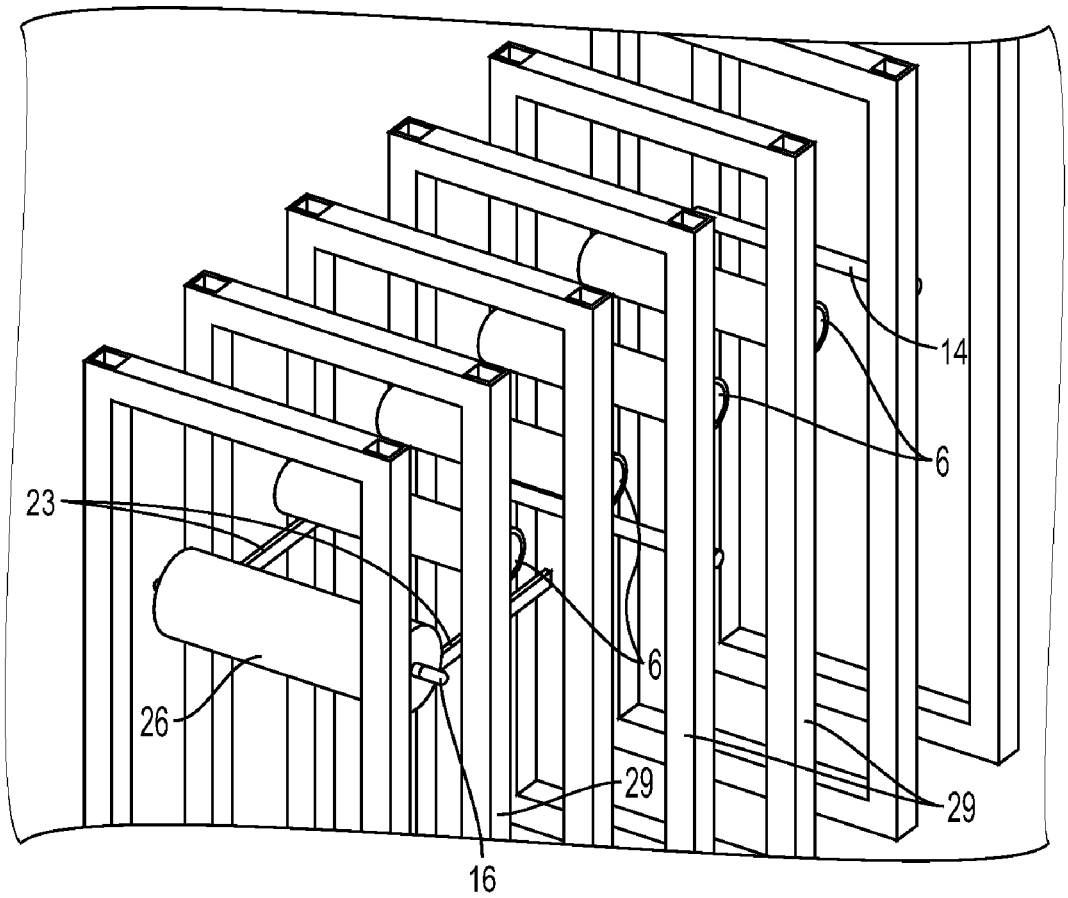
FIG. 3 illustrates the cartridge of this invention mounted on a print engine drive or idler roll.

In FIG. 3, the cartridge 26 is shown mounted on a drive/idler roll 16 (see FIG. 1) so that it may rotate as the belt 3 unwinds from its packed position as shown in FIG. 4. FIG. 3 shows four modules 6 whereas in FIG. 1 six imaging modules are depicted. Any suitable number of modules greater than one module 6 may be used. Obviously, the present invention becomes more important for longer belt 3 installation. In FIG. 3, only shafts or racks 23 are shown in one module 6 for clarity. However, the racks 23 would extend throughout the travel path of traveling roll 21 until it reaches end roll 14. The racks 23 will be supported on frame members 29, the travel roll 21 as shown in FIG. 4 will travel on racks 23 and as travelling roll 21 moves toward end roll 14, the belt 3 will unravel around cartridge rolls 18 until the belt 3 is fully traversed to print device shaft 14 position by the traveling roll 21. The roll 16 will fit through bore or conduit 24 so that the cartridge 26 (with caps 19 and 20 and cartridge rolls 18) will rotate around roll 16 during installation as shown in FIG. 2A.

FIG. 4 shows the belt 3 at the beginning of the belt 3 installation process. The belt 3 is wound around center rolls 18A and then fully wound around rolls 18. Any suitable number of rolls 18 may be used greater than one depending upon the length of the belt 3. The sheath 17 is removed showing the kit components 18 and 18A as they are mounted on first roller roll 16 (of FIG. 2A) for rotation. As the caps 19 and 20 rotate on first roll 16, the belt unwinds as pulled by traveling roll 21 along the belt installation path. Knob 22 can be turned manually or electrically to move travel roll 21 down the length of racks 23 whether racks 23 extend only through one module as shown in FIG. 6 or four modules as shown in FIG. 3 or six modules as shown in FIG. 1.

Once the travel roll 21 reaches its destination (in this case roll 14 of FIG. 1), the drive/idler roll 14 is inserted into the end loop of belt 3 and travelling roll 21 is removed and the belt 3 wrapped around roll 14. On one end, for example, roll 16 supports belt 3 and on the other opposite end roll 14 supports belt 3. Once the belt 3 is in place around rolls 16 and 14, the other rolls 8-13 and 15 of FIG. 1 are put back in place.

Figure 5:
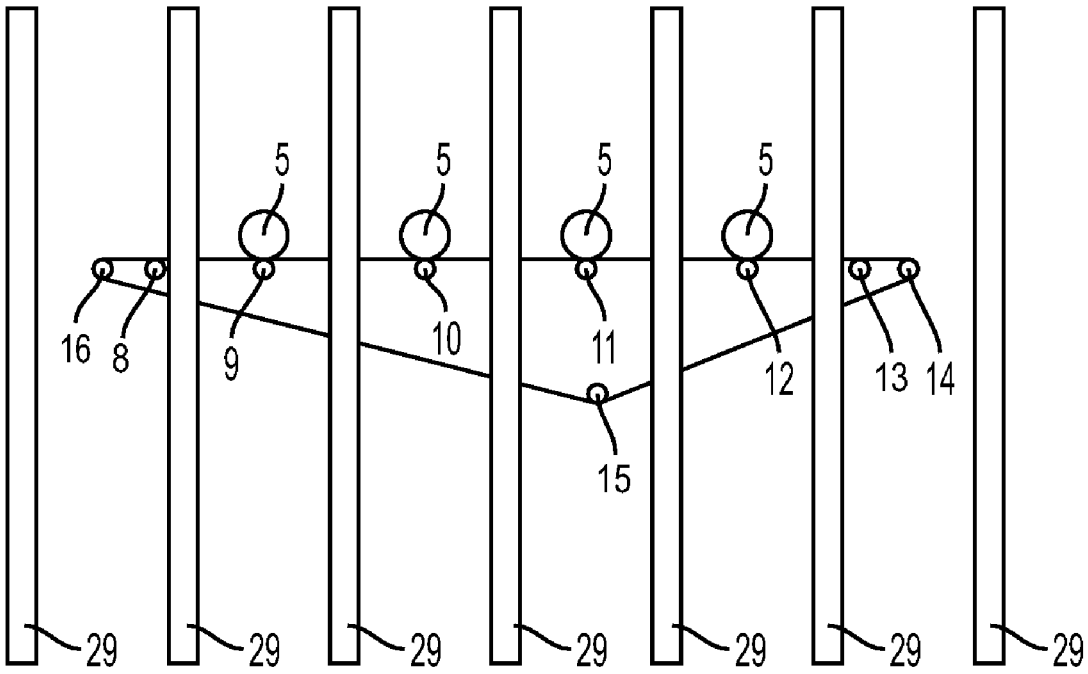
FIG. 5 illustrates the belt installed and in working position with the cartridge and traveling roll removed.

FIG. 5 shows only a four module printing apparatus so that rolls 8-13 and 15 are put back or returned in place while rolls 16 and 14 remain as the outer rolls used during installation.

Figure 6:
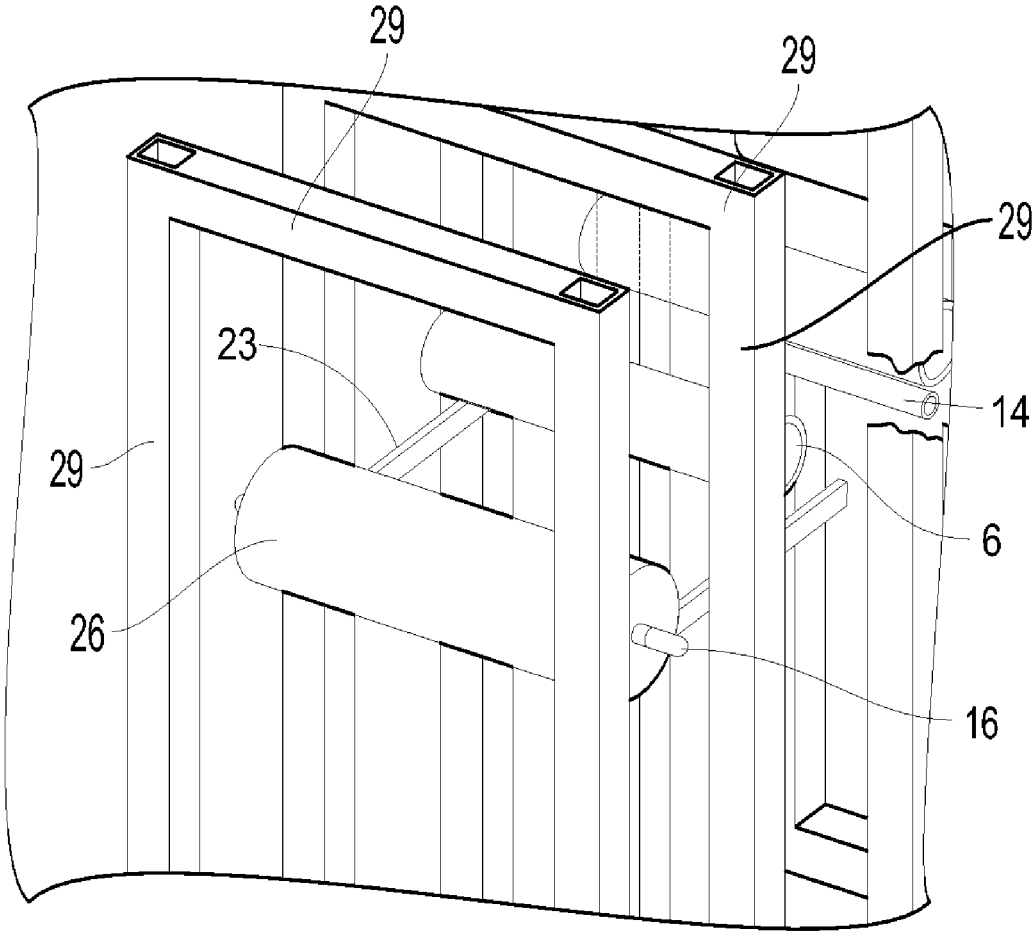
FIG. 6 shows one xerographic module with the cartridge mounted on one xerographic module of the print engine idler or drive roll.

FIG. 6 shows at the beginning of the belt 3 installation, a one of six module printer with the cartridge 26 positioned on drive/idler roll 16 (of FIG. 1). Any number of module-printers may be used. In this FIG. 6, the mounting of cartridge 26 is shown and the positioning of racks 23 upon which travel roll 21 moves is clearly shown in FIG. 6. Racks 23 are supported on the inside surface of frame members 29.

Each module (six modules in FIG. 1, four modules in FIG. 3 and one module in FIG. 6) would have its own racks 23 located on the inside of its frame members 29. The racks 23 would be all aligned so that traveling roll 21 could travel from one end of the belt connections to the opposite ends such as from roll 16 to roll 14 of FIG. 1. The traveling roll 21 would move on the pair of or two racks 23 on each side of the two frame members 29. Once installed, the traveling roll 21 is removed and in its place would fit the drive roll 14, for example. The racks 23 could also be removed or could be folded out of the way to stay in the print device 1 for future use. After belt installation, roll 15 of FIG. 1 is usually the last roll to be returned in place. The traveling roll 21 and racks 23 can be made of any suitable materials such as plastic, metals such as aluminum or any other suitable material.

In summary, this invention provides a kit or cartridge useful in installing an endless belt in a module(s) of a belt-containing system. This cartridge comprises, in addition to a belt to be installed, a sheath to cover and contain cartridge components, at least two internal cartridge rolls around which the belt is wound, a traveling roll around which the belt is positioned and gear racks on which the traveling roll will move. The belt is enabled to be movably connected on one end to one of the internal cartridge rolls and on an opposite end to the traveling roll. The end caps have conduits located at each end of the internal cartridge rolls.

The gear racks are enabled to be connected to internal sides of frame members located in the module. The at least two internal cartridge rolls are preferably from 2 to 5 internal cartridge rolls; however, any suitable number of cartridge rolls may be used The traveling roll is configured to move on and along the racks from one end of the module to an opposite end. The conduits are adapted to receive therein a drive/idler roll and are enabled to rotate around the drive/idler roll during a belt installation process. The belt is configured to unwind from around the internal cartridge rolls as the travel roll moves away from the cartridge rolls. The cartridge is useful in systems having from 1 to a plurality of modules. Any suitable number of modules may be used.

All components of the cartridge except the endless belt are enabled to be disposed of and removed from the module after a belt installation. The cartridge is configured to be mounted on an original print engine drive/idler roll.

The cartridge is especially useful in a belt installation of a xerographic marking system. The cartridge wherein the belt is configured to be installed in a xerographic marking system uses this belt to replace a belt selected from the group consisting of media belts, photoconductor belts, photoreceptor belts, intermediate transfer belts, electrostatic belts, transport belts, cleaning belts and mixtures thereof.

The embodiments of this invention comprise a kit or cartridge especially useful in installing an endless belt in a module(s) of a xerographic marking system. The cartridge comprises, in addition to a belt to be installed, a sheath to cover and contain cartridge components, at least two internal cartridge rolls around which the belt is wound, a traveling roll around which the belt is positioned and gear racks on which the traveling roll will move. The belt is enabled to be movably connected on one end to one of said internal cartridge rolls with end caps with conduits that are located at each end of the internal cartridge rolls and on an opposite end to the traveling roll. The traveling roll comprises a turn knob for moving the traveling roll along these gear racks through an entire path of the traveling roll. The cartridge contains three internal cartridge rolls.

The endless belt is enabled to be looped at one terminal end around one of the internal cartridge rolls and at an opposite terminal end around the traveling roll enabled to thereby cause the belt to unwind from around the three internal cartridges as the traveling roll moves away from the internal cartridge rolls.

The belt-installing method of this invention in an embodiment comprises in a modular apparatus the use of an endless belt. The apparatus contains a plurality of belt-supporting and driver/idler rolls. This method comprises connecting a cartridge with at least two internal cartridge rolls to a first occurring of the rolls. The cartridge comprises a wound up endless belt, removing all other rolls except the first occurring roll from the apparatus, positioning a traveling roll at an original position on supporting racks adjacent the first occurring of the rolls, moving the traveling roll away from the cartridge and the first occurring of the rolls until it causes the endless belt to unwind from around the internal cartridge rolls.

The last occurring roll is inserted through or in front of the traveling roll where the unwound endless belt is looped around the last occurring roll. Subsequently, the cartridge is removed and the traveling roll is removed from the apparatus to thereby result in an installation of the endless belt in place in the apparatus. In one embodiment, the apparatus is an electrophotographic marking apparatus. In this method, the endless belt is looped around the first occurring and the last occurring rolls before all other removed rolls are replaced in the apparatus. The apparatus comprises any suitable number of modules greater than 1.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A cartridge useful in installing an endless belt in a one or more modules of a belt containing system, said cartridge comprising:

at least two internal cartridge rolls around which said belt is wound, a travelling roll around which said belt is positioned, and gear racks on which said traveling roll will move, said belt being movably connected on one end to one of said internal cartridge rolls and on an opposite end to said traveling roll, end caps located at each end of said internal cartridge rolls, said end caps and internal cartridge rolls having conduits therethrough, and a sheath to cover and contain said internal cartridge rolls.

2. The cartridge of claim 1 wherein said gear racks are enabled to be connected to internal sides of frame members located in said one or more modules.

3. The cartridge of claim 1 wherein said at least two internal cartridge rolls are from 2 to 5 internal cartridge rolls.

4. The cartridge of claim 1 wherein said traveling roll is configured to move on and along said gear racks from one end to an opposite end of said one or more modules.

5. The cartridge of claim 1 wherein said conduits are adapted to receive therein a drive roll or idler roll and enabled to rotate around said drive roll or idler roll during a belt installation process.

6. The cartridge of claim 1 wherein said belt is configured to unwind from around said internal cartridge rolls as said travelling roll moves away from said internal cartridge rolls.

7. The cartridge of claim 1 wherein all components of said cartridge except said belt are enabled to be disposed of and removed from said one or more modules after a belt installation.

8. The cartridge of claim 1 wherein said cartridge is configured to be mounted on an original print engine drive roll or idler roll.

9. The cartridge of claim 1 adapted to be useful in a belt installation in a xerographic marking system.

10. The cartridge of claim 1 wherein said belt is configured to be installed in a xerographic marking system, said belt used to replace a belt selected from the group consisting of media belts, photoconductor belts, photoreceptor belts, intermediate transfer belts, electrostatic belts, transport belts, cleaning belts, and mixtures thereof.

11. A cartridge useful in installing an endless belt in one or more modules of a Xerographic marking system said cartridge comprising:

at least two internal cartridge rolls around which said belt is wound, a traveling roll around which said belt is positioned, and gear racks on which said traveling roll will move, said belt being movably connected on one end to one of said internal cartridge rolls and on an opposite end to said traveling roll, and end caps located at each end of said internal cartridge rolls, said end caps and internal cartridge rolls having conduits therethrough, and a sheath to cover and contain said internal cartridge rolls said traveling roll comprising a turn knob for moving said traveling roll along said gear racks through an entire path of said traveling roll, and said cartridge containing three internal cartridge rolls, said belt looped at one terminal end around one of said internal cartridge rolls, and at an opposite terminal end around said traveling roll enabled to thereby cause said belt to unwind from around said three internal cartridges as said traveling roll moves away from said internal cartridge rolls.

12. The cartridge of claim 11 wherein said gear racks are enabled to be connected to internal sides of frame members located in said one or more modules.

13. The cartridge of claim 11 wherein said traveling roll is configured to move on and along said gear racks from one end to an opposite end of said one or more modules.

14. The cartridge of claim 11 wherein said conduits are adapted to receive therein a drive roll or idler roll and enabled to rotate around said drive roll or idler roll during a belt installation process.

15. The cartridge of claim 11 wherein said cartridge is useful to install said belts in xerographic marking systems having from 1-20 modules.

16. A method for installing an endless belt in a modular apparatus using an endless belt, said apparatus containing a plurality of belt-supporting drive rolls or idler rolls, said method comprising: connecting a cartridge with at least two internal cartridge rolls to a first occurring of said drive rolls or idler rolls, said cartridge comprising a wound up endless belt, removing all other said drive rolls or idler rolls from said apparatus, positioning a traveling roll at an original position on supporting racks adjacent said first occurring of said drive rolls or idler rolls, moving said traveling roll away from said cartridge and said first occurring drive roll or idler roll until it causes said endless belt to unwind from around said internal cartridge rolls, moving said traveling roll from said original position to position adjacent a previously removed last occurring drive roll or idler roll where said last occurring drive roll or idler roll is inserted through said unwound endless belt, removing said cartridge and said traveling roll from said apparatus to thereby result in an installation of said endless belt in place in said apparatus.

17. The method of claim 16 wherein said apparatus is an electrophotographic marking apparatus.

18. The method of claim 16 wherein said endless belt is looped around said first occurring and said last occurring drive roll or idler roll before all other removed drive roll or idler roll are replaced in said apparatus.

19. The method of claim 16 wherein said apparatus comprises from 1 to 10 modules.

* * * * *